US012331986B2

(12) United States Patent
Byeon et al.

(10) Patent No.: US 12,331,986 B2
(45) Date of Patent: Jun. 17, 2025

(54) REFRIGERATOR AND HOUSEHOLD APPLIANCE

(71) Applicant: SAMSUNG ELECTRONICS CO., LTD., Suwon-si (KR)

(72) Inventors: Seungwon Byeon, Suwon-si (KR); Jisu Rhie, Suwon-si (KR); Sungmo Kim, Suwon-si (KR); Jonghoon Oh, Suwon-si (KR); Seungyong Yang, Suwon-si (KR); Inyong Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 306 days.

(21) Appl. No.: 18/063,474

(22) Filed: Dec. 8, 2022

(65) Prior Publication Data

US 2023/0106093 A1 Apr. 6, 2023

Related U.S. Application Data

(63) Continuation of application No. PCT/KR2021/002607, filed on Mar. 3, 2021.

(30) Foreign Application Priority Data

Jun. 17, 2020 (KR) ..... 10-2020-0073902

(51) Int. Cl.
*F25D 23/12* (2006.01)
*F25D 11/00* (2006.01)

(52) U.S. Cl.
CPC ..... *F25D 23/12* (2013.01); *F25D 11/00* (2013.01); *F25D 2321/1441* (2013.01); *F25D 2400/36* (2013.01); *F25D 2400/40* (2013.01)

(58) Field of Classification Search
CPC .. F25D 23/12; F25D 11/00; F25D 2321/1441; F25D 2400/36; F25D 2400/40
See application file for complete search history.

(56) References Cited

U.S. PATENT DOCUMENTS

2018/0183912 A1* 6/2018 Lim ..... G06F 1/1652
2018/0249827 A1* 9/2018 Kim ..... F24F 1/0358
2021/0378113 A1* 12/2021 Wang ..... G09F 9/00

FOREIGN PATENT DOCUMENTS

CN 106382779 A 2/2017
CN 106382779 * 12/2017
CN 206695501 * 12/2017
CN 206695501 U 12/2017
(Continued)

OTHER PUBLICATIONS

International Search Report and Written Opinion of the International Searching Authority dated Jun. 24, 2021, in connection with International Application No. PCT/KR2021/002607, 9 pages.

*Primary Examiner* — Henry T Crenshaw

(57) ABSTRACT

A refrigerator includes: a main body forming a storage room; a display positioned on a bottom of the storage room and including a display board; a separating wall extending from the bottom of the storage room toward the display and forming a board accommodating space for accommodating the display board, the separating wall is configured to partition the board accommodating space from a water collecting space positioned between the bottom of the storage room wall and the display.

20 Claims, 12 Drawing Sheets

(56) References Cited

FOREIGN PATENT DOCUMENTS

| | | | |
|---|---|---|---|
| CN | 108151400 | A | 6/2018 |
| JP | 2000199672 | A | 7/2000 |
| JP | 3404224 | B2 | 5/2003 |
| JP | 2004044980 | A | 2/2004 |
| JP | 2008039356 | A | 2/2008 |
| KR | 10-2002-39165 | Y1 | 10/2001 |
| KR | 10-0682665 | B1 | 2/2007 |
| KR | 10-2010-0025711 | A | 3/2010 |
| KR | 10-1065521 | B1 | 9/2011 |
| KR | 10-2014-0092636 | A | 7/2014 |
| KR | 10-1912405 | B1 | 10/2018 |

* cited by examiner

REFRIGERATOR AND HOUSEHOLD APPLIANCE

CROSS-REFERENCE TO RELATED APPLICATIONS

This application is a bypass continuation of PCT/KR2021/002607, filed Mar. 3, 2021, which is based on and claims priority under 35 U.S.C. § 119 to Korean Patent Application No. 10-2020-0073902 filed on Jun. 17, 2020, in the Korean Intellectual Property Office, the disclosures of which are incorporated by reference herein in their entirety.

BACKGROUND

1. Field

The present disclosure relates to a refrigerator and a household appliance, and more particularly, to a refrigerator having a display.

2. Description of Related Art

In general, a refrigerator is an appliance for freshly storing food at a low temperature by supplying low-temperature cool air to a storage room where the food is stored.

Existing refrigerators have performed a simple function of storing food at a low temperature. However, recently, needs for other functions, in addition to a function of storing food, are increasing.

Accordingly, lately, a refrigerator including a display having an input/output function is being developed. More specifically, the display may be installed on a door or in a storage room. In the case in which the display is installed in the storage room, the display is positioned specifically on the top or side surface of the storage room or on a shelf provided in the storage room to be prevented from exposure to moisture. In the case in which the display is positioned on the top or side surface of the storage room or on the shelf of the storage room, users may have less access to the display.

Meanwhile, in the case in which the display is positioned inside the storage room, the display may be deformed by an inside temperature of the storage room.

SUMMARY

An aspect of the disclosure provides a refrigerator that enables a user to easily access a display.

Another aspect of the disclosure provides a refrigerator capable of preventing a display from exposure to moisture.

Still another aspect of the disclosure provides a refrigerator and a household appliance capable of facilitating assembly and/or disassembly of parts such as a display.

A refrigerator according to a concept of the present disclosure includes: a main body forming a storage room; a display positioned on a bottom of the storage room and including a display board; and a separating wall extending from the bottom of the storage room toward the display and forming a board accommodating space for accommodating the display board, where the separating wall is configured to partition the board accommodating space from a water collecting space positioned between the bottom of the storage room and the display.

The refrigerator may further include a seal positioned between the separating wall and the display and configured to seal the board accommodating space from the water collecting space.

The separating wall is formed in a shape of a closed loop to form the board accommodating space.

A bottom of the board accommodating space may be lower than a bottom of the water collecting space.

The board accommodating space may include a wire connecting space configured to guide a wire of the display to an outside of the storage room.

The display board may be spaced from the bottom of the storage room within the board accommodating space.

The refrigerator may further include a drain hole formed in the bottom of the storage room, wherein the main body may guide water of the water collecting space to the drain hole.

The refrigerator may further include a guide portion formed on the bottom of the storage room, wherein the display may include a guide body that is guided by the guide portion for installation on the main body.

The refrigerator may further include a fixer configured to selectively fix the display to the main body.

The fixer may be rotatable between a first position of releasing the display from the main body and a second position of fixing the display to the main body.

The fixer may include a pressing portion configured to press the display at the second position.

The refrigerator may further include a storage container provided in the storage room, wherein the fixer may be hidden by the storage container at the second position.

The fixer may include a fixing portion protruding from the storage container to be exposed to outside at the first position.

The refrigerator may further include a stopper protruding from the bottom of the storage room, wherein the fixer may include a rotation limiting portion supported in a first direction by the display and a catching portion supported in a second direction which is opposite to the first direction by the stopper, at the second position.

The refrigerator may further include: a storage container provided in the storage room; and a heater configured to provide heat to the storage container, the heater being adjacent to the water collecting space.

In another aspect, a household appliance according to a concept of the disclosure includes: a main body; a part detachably coupled with the main body; and a fixer configured to be rotatable between a first position of releasing the part from the main body and a second position of fixing the part to the main body, the fixer including a fixing portion exposed to an outside of the main body at the first position.

The fixer may include a pressing portion configured to press the part at the second position, and the pressing portion may be spaced from the part at the first position of the fixer.

At the second position of the fixer, a first end of the part may be supported by the fixer, and a second end of the part, which is opposite to the first end of the part, may be supported by the main body.

The fixer may include a rotation limiting portion supported by the part and configured to prevent the fixer from rotating in an opposite direction of a direction of rotating to the first position, at the second position of the fixer.

In still another aspect, a refrigerator according to a concept of the disclosure includes: a main body forming a storage room; a display positioned on a bottom of the storage room and including a display board; a separating wall extending from the bottom of the storage room toward the display and forming a board accommodating space for accommodating the display board, the separating wall may be configured to partition the board accommodating space from a water collecting space positioned between the bottom of the storage room and the display; and a fixer configured to be rotatable between a first position of releasing the display from the main body and a second position of fixing the display to the main body, the fixer including a fixing portion protruding into the storage room at the first position.

According to a concept of the disclosure, because a display is positioned on a bottom of a storage room, a user may easily access the display.

According to a concept of the disclosure, because a separating wall provided between a display and a bottom of a storage room separates a board accommodating space from a water collecting space, the display may be prevented from being exposed to moisture.

According to a concept of the disclosure, a refrigerator and a household appliance may facilitate assembly and/or disassembly of parts such as a display by including a fixer configured to selectively fix the parts.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
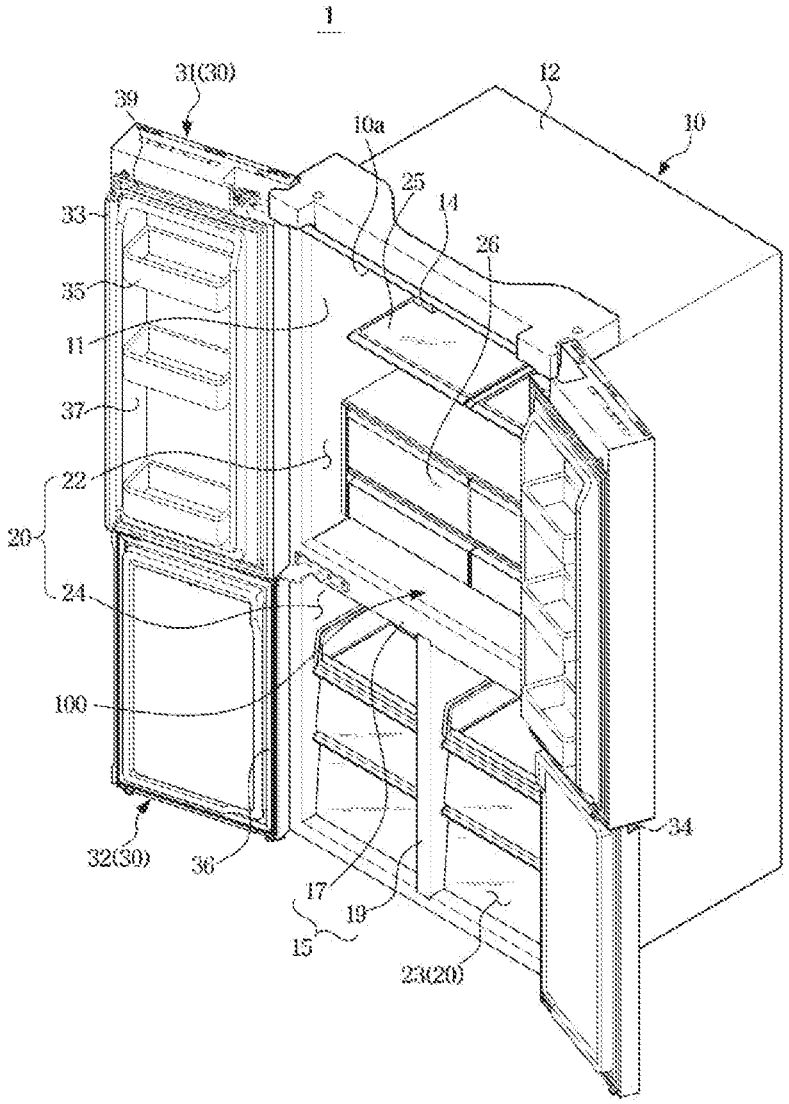
FIG. 1 shows a refrigerator according to an embodiment of the disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are used to describe the embodiments. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "rear", "upper", and "lower" are defined based on the drawings, and the shapes and positions of the components are not limited by the terms.

Hereinafter, an embodiment of the disclosure will be described in detail with reference to the accompanying drawings.

FIG. 1 shows a refrigerator according to an embodiment of the disclosure.

Referring to FIG. 1, a refrigerator 1 may include a main body 10, a storage room 20 partitioned into upper and lower spaces inside the main body 10, a door 30 for opening or closing the storage room 20, and a cool air supplier (not shown) for supplying cool air to the storage room 20.

The main body 10 may include an inner case 11 forming the storage room 20, an outer case 12 coupled with an outer side of the inner case 11 and forming an outer appearance, and a main body insulation 13 foamed between the inner case 11 and the outer case 12 to insulate the storage room 20.

The cool air supplier may generate cool air by using a cooling circulation cycle of compressing, condensing, expanding, and evaporating a refrigerant.

The storage room 20 may be partitioned into a plurality of storage rooms 22, 23, and 24 by a partition 15, and the partition 15 may include a first partition 17 coupled horizontally with an inner surface of the storage room 20 to partition the storage room 20 into an upper storage room (or a first storage room) 22 and lower storage rooms 23 and 24, and a second partition 19 coupled vertically with inner surfaces of the lower storage rooms 23 and 24 to partition the lower storage rooms 23 and 24 into a second storage room 23 and a third storage room 24.

The partition 15 having a T shape by coupling of the first partition 17 and the second partition 19 may partition the storage room 20 into three spaces. The upper storage room 22 among the upper storage room 22 and the lower storage rooms 23 and 24 partitioned by the first partition 17 may be used as a refrigerating room, and the lower storage rooms 23 and 24 may be used as freezing rooms.

Both the lower storage rooms 23 and 24 may be used as freezing rooms, the second storage room 23 may be used as a freezing room while the third storage room 24 may be used as a refrigerating room, and the second storage room 23 may be used as a freezing room while the third storage room 24 may be used as any one of a freezing room and a refrigerating room.

The above-described partitioning of the storage room 20 is an example, and the storage rooms 22, 23, and 24 may be used differently from the above description.

Inside the storage room 20, a plurality of shelves 25 and a storage container 26 may be provided to store food, etc.

A plurality of storage containers 26 may be provided, and the plurality of storage containers 26 may have different sizes. Various foods including meat, vegetables, wine, etc. may be accommodated in the storage container 26. Inside temperature of the storage container 26 may be set to be different from inside temperature of the upper storage room 22.

The storage room 20 may be opened or closed by the door 30. The door 30 may include a pair of first doors (or upper doors) 31 for opening or closing the upper storage room 22, and a pair of second doors (or lower doors) 32 for opening or closing the lower storage rooms 23 and 24. The pair of first doors 31 and the pair of second doors 32 may open or close a main body opening 10*a* of the main body 10.

In one of the pair of first doors 31, a rotating bar 33 may be provided. The rotating bar 33 may close a gap between the pair of first doors 31 upon closing of the pair of first doors 31. In the main body 10, a rotating bar guide 14 for guiding a movement of the rotating bar 33 may be provided.

The upper storage room 22 may be opened or closed by the first doors 31 rotatably coupled with the main body 10. Each first door 31 may be opened or closed through a first door handle (not shown). The first door handle may be formed in a bottom of the first door 31 as recessed from the bottom of the first door 31.

On a rear surface of the first door 31, a door shelf 35 for accommodating food may be provided. The door shelf 35 may include a shelf supporting portion 37 extending perpendicularly from the first door 31 to support the door shelf 35 at both sides of the door shelf 35. The shelf supporting portion 37 may be provided as a separate component to be separable from the first door 31, and in the current embodiment, the shelf supporting portion 37 may protrude backward from the rear surface of the first door 31 and extend in an up-down direction.

At an edge of the rear surface of the first door 31, a first gasket 39 may be provided to seal a gap between the first door 31 and the main body 10 in a closed state of the first door 31. The first gasket 39 may be formed in a shape of a loop along the edge on the rear surface of the first door 31, and a first magnet (not shown) may be included inside the first gasket 39.

The lower storage rooms 23 and 24 may be opened or closed by the second doors 32 rotatably coupled with the main body 10. Each second door 32 may be opened or closed through a second door handle 34. The second door handle 34 may be formed in a top surface of the second door 32 as recessed from the top surface of the second door 32. The second door 32 may be provided in a sliding manner, although not limited thereto.

At an edge of the rear surface of the second door 32, a second gasket 36 may be provided to seal a gap between the second door 32 and the main body 10 in a closed state of the second door 32. The second gasket 36 may be formed in a shape of a loop along the edge on the rear surface of the second door 32, and a second magnet (not shown) may be included inside the second gasket 36.

Figure 2:
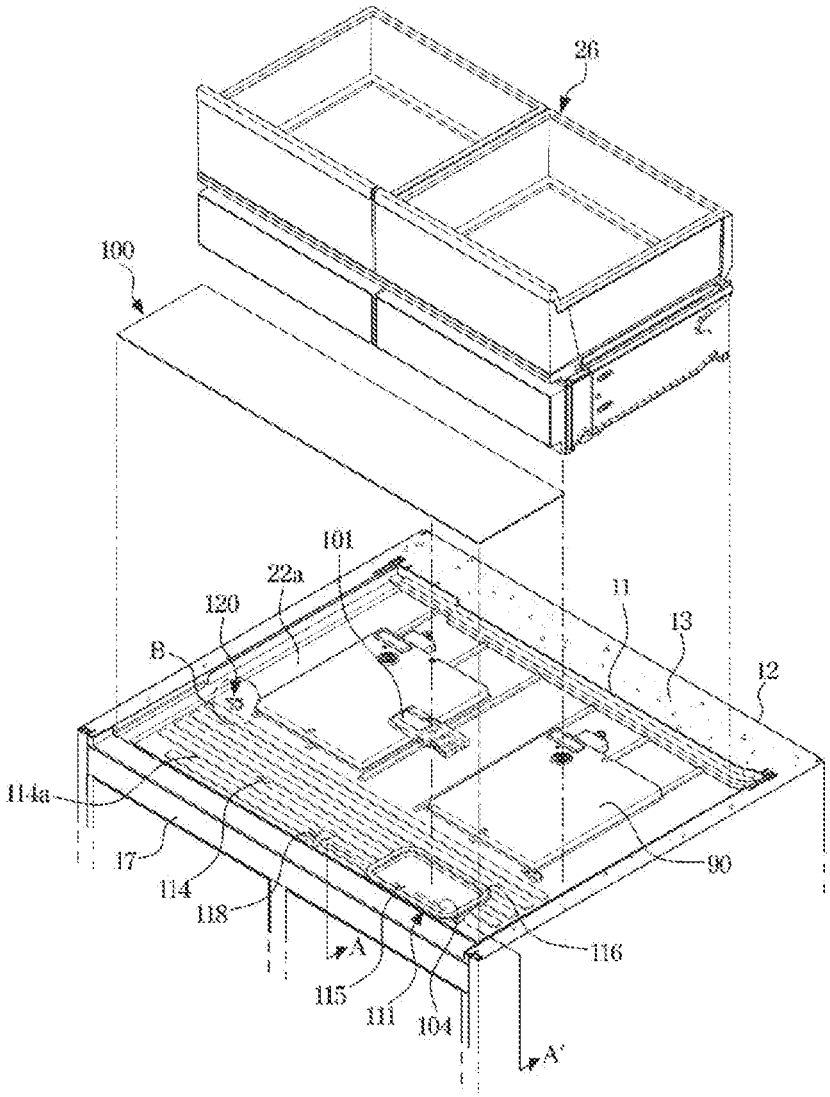
FIG. 2 shows sections of a display and a storage container separated from a main body of the refrigerator shown in FIG. 1.
Figure 3:
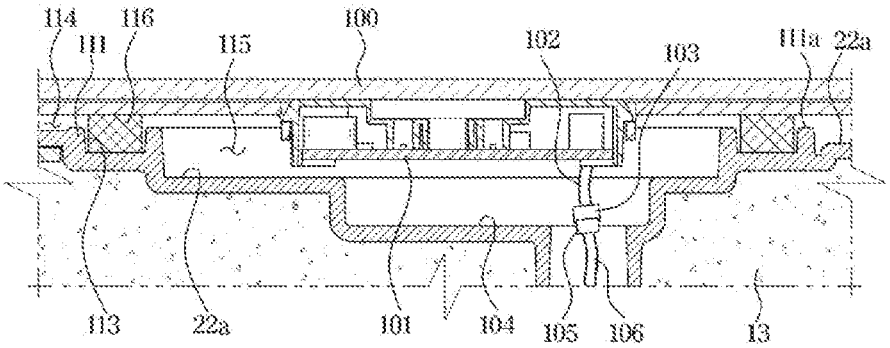
FIG. 3 is a cross-sectional view taken along line A-A' denoted in FIG. 2.

FIG. 2 shows sections of a display and a storage container separated from a main body of the refrigerator shown in FIG. 1. FIG. 3 is a cross-sectional view taken along line A-A' denoted in FIG. 2.

Referring to FIG. 2, a heater 90 may be provided below the storage container 26. The heater 90 may maintain temperature of the storage container 26 at temperature that is higher than that of the upper storage room 22.

Referring to FIGS. 2 and 3, a display 100 may be mounted on a bottom 22*a* of the upper storage room 22. The display 100 may display various information about the refrigerator 1. The display 100 may be configured to receive a command from a user. Because the display 100 is positioned on the bottom 22*a* of the upper storage room 22, the user may easily access the display 100.

According to mounting of the display 100 on the bottom 22*a* of the upper storage room 22, a water collecting space 114 and a board accommodating space 115 may be formed between the display 100 and the bottom 22*a* of the upper storage room 22.

The water collecting space 114 may collect water generated from the upper storage room 22. Water introduced to the water collecting space 114 may be naturally dried. Water introduced to the water collecting space 114 may be dried by the heater 90. The heater 90 may be adjacent to the water collecting space 114. The water collecting space 114 may be partitioned from the board accommodating space 115.

In the water collecting space 114, a water collecting guide 114*a* may be formed. The water collecting guide 114*a* may protrude upward from the bottom 22*a* of the upper storage room 22 by a preset height. The water collecting guide 114*a* may extend in a left-right direction of the upper storage room 22. A plurality of water collecting guides 114*a* may be provided, and a groove may be formed between the plurality of water collecting guides 114*a*.

A display board 101 for driving the display 100 may be positioned in the board accommodating space 115. The display board 101 may be installed on the display 100. The display board 101 may be electrically connected with the display 100. The display board 101 may be spaced from the bottom 22*a* of the upper storage room 22. The display board 101 may be included in the display 100.

A wire connecting space 104 may be formed on a bottom of the board accommodating space 115. The wire connecting space 104 may guide a board wire 102 to outside of the upper storage room 22. The wire connecting space 104 may form a space where the board wire 102 of the display board 101 is electrically connected with a main body wire 106 provided in the main body 10. More specifically, in the wire connecting space 104, a board connector 103 of the board wire 102 may be connected with a main body connector 105 of the main body wire 106. Accordingly, the display board 101 may transmit/receive information to/from a controller (not shown) provided in the main body 10, and receive power supplied to the refrigerator 1.

On the bottom 22*a* of the upper storage room 22, a separating wall 111 for separating the board accommodating space 115 from the water collecting space 114 may be formed. The separating wall 111 may be formed in a shape of a closed loop. The board accommodating space 115 may be formed inside the separating wall 111. The separating wall 111 may protrude upward from the bottom 22*a* of the upper storage room 22. The separating wall 111 may extend toward the display 100 from the bottom 22*a* of the upper storage room 22.

An upper surface 111*a* of the separating wall 111 may have a height that is higher than a bottom of the water collecting space 114. The upper surface 111*a* of the separating wall 111 may have a height that is higher than the bottom of the board accommodating space 115. The bottom of the board accommodating space 115 may be lower than the bottom of the water collecting space 114. The bottom of the board accommodating space 115 may be lower than the bottom 22*a* of the upper storage room 22.

In the separating wall 111, a seal installing portion 113 may be formed. The seal installing portion 113 may accommodate a seal 116. The seal 116 may be positioned in the seal installing portion 113.

The seal 116 may be positioned between the display 100 and the bottom 22*a* of the upper storage room 22 to seal the board accommodating space 115 from the water collecting space 114. The seal 116 may be formed to correspond to the shape of the closed loop of the separating wall 111.

The board accommodating space 115 may be partitioned from the water collecting space 114 by the separating wall 111 and the seal 116, and accordingly, the display 100 and the display board 101 may be protected from moisture.

Figure 4:
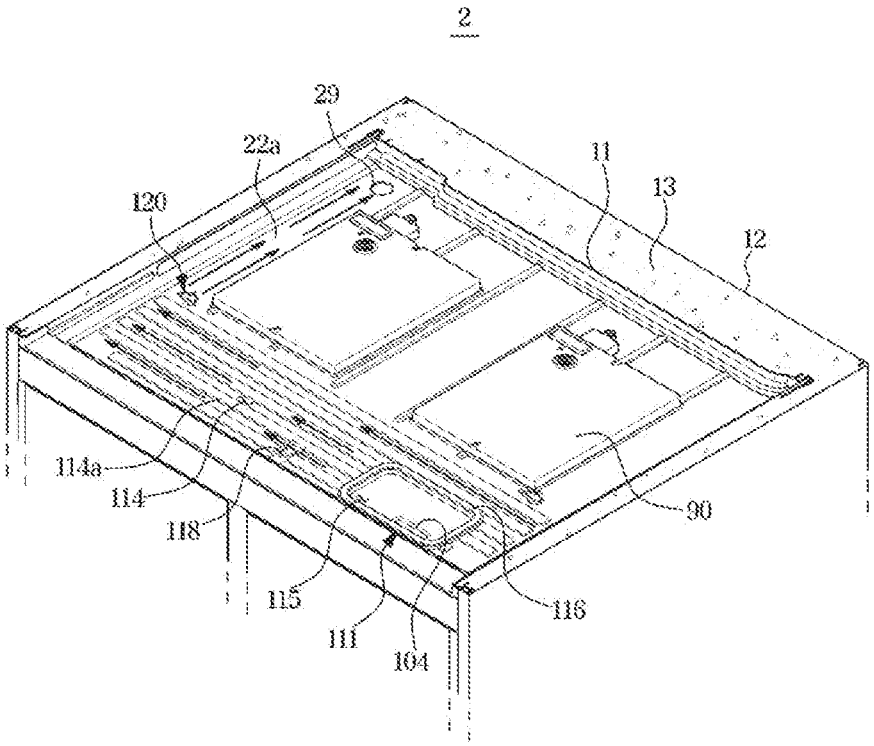
FIG. 4 shows another embodiment of the refrigerator shown in FIG. 2.

FIG. 4 shows another embodiment of the refrigerator shown in FIG. 2.

A refrigerator 2 according to an embodiment of the disclosure will be described with reference to FIG. 4. The same components as those of the refrigerator 1 shown in FIGS. 1 to 3 may be assigned the same reference numerals, and detailed descriptions thereof will be omitted.

Referring to FIG. 4, in the refrigerator 2 according to another embodiment of the disclosure, a drain hole 29 may be formed in the bottom 22*a* of the upper storage room 22. More specifically, the drain hole 29 may be positioned at a rear side of the bottom 22*a* of the upper storage room 22.

The bottom 22*a* of the upper storage room 22 may be inclined downward at a preset angle toward a rear direction. The refrigerator 1 may be installed such that the bottom 22*a* of the upper storage room 22 may be inclined downward at a preset angle toward a rear direction, as necessary. Accordingly, water collected in the water collecting space 114 may be guided to one side of the upper storage room 22 by the water collecting guide 114*a*, and the water guided to the one side may be guided to the drain hole 29 and discharged from the upper storage room 22.

According to the configuration, water collected in the water collecting space 114 may be more quickly removed than in a case in which water is dried by the heater 90.

Figure 5:
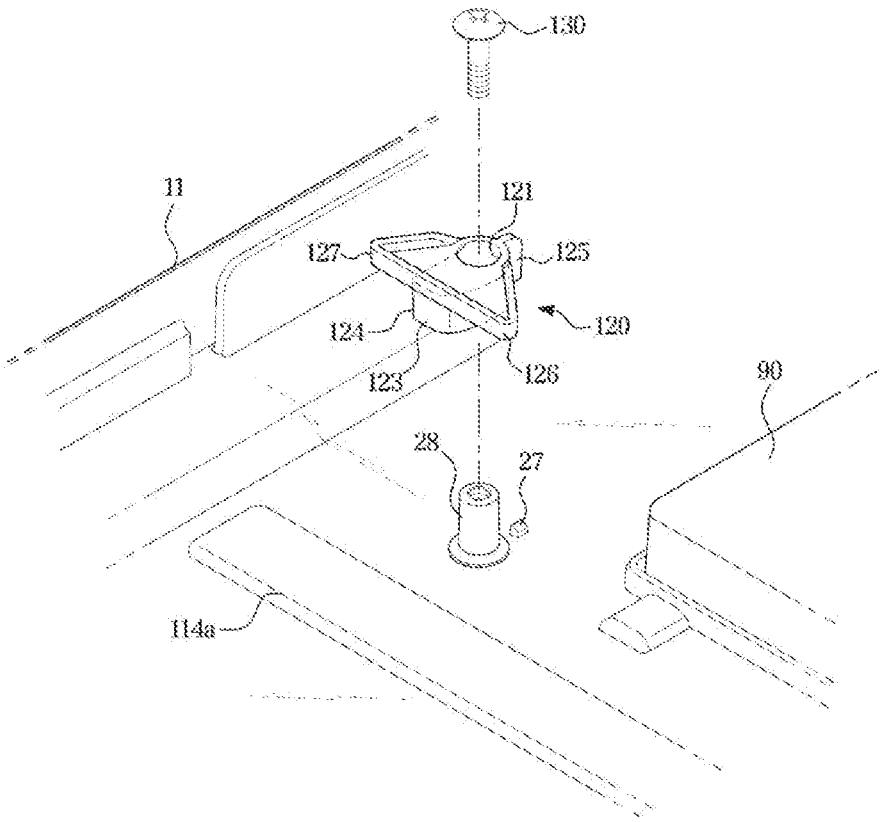
FIG. 5 is an enlarged view of an area B denoted in FIG. 2, showing a state in which a fixer is separated from the main body.
Figure 6:
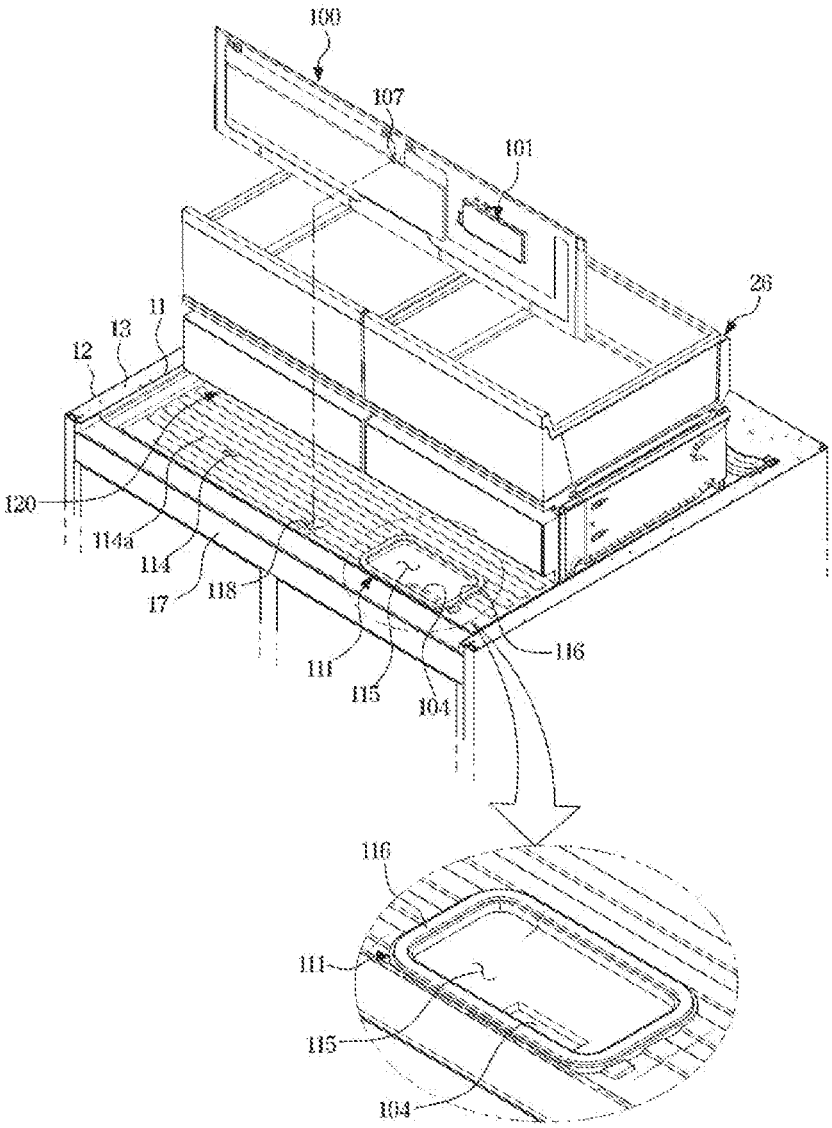
FIG. 6 shows a state in which the display shown in FIG. 2 is separated from the main body.
Figure 7:
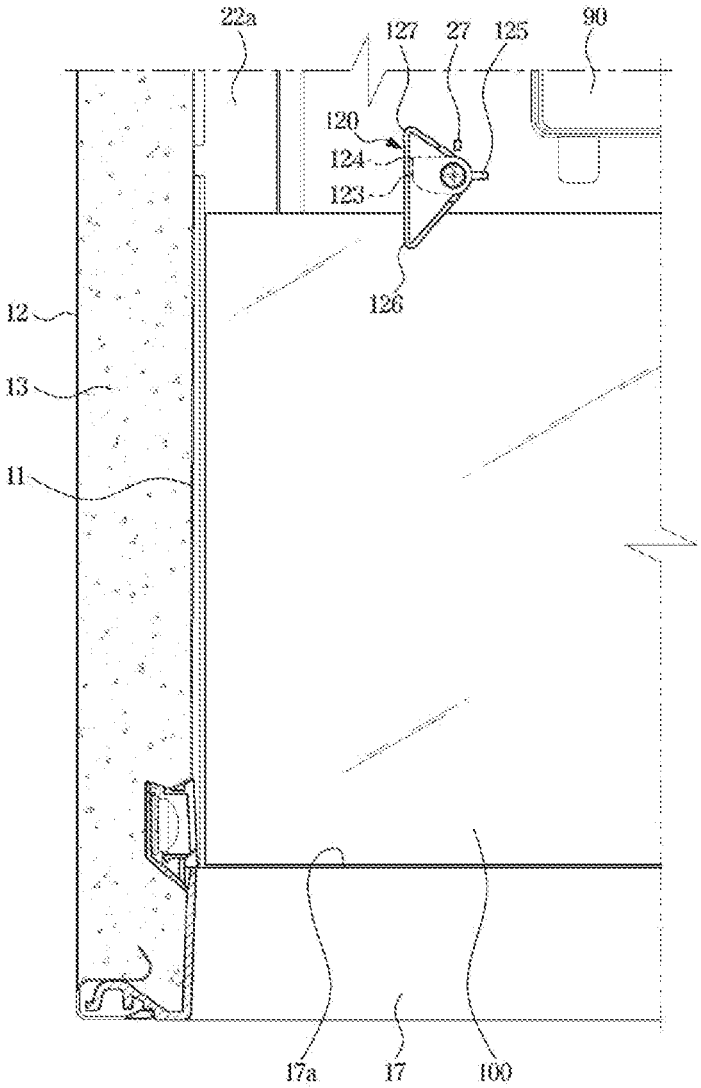
FIG. 7 shows a state in which the fixer shown in FIG. 5 is oriented in a first position.
Figure 8:
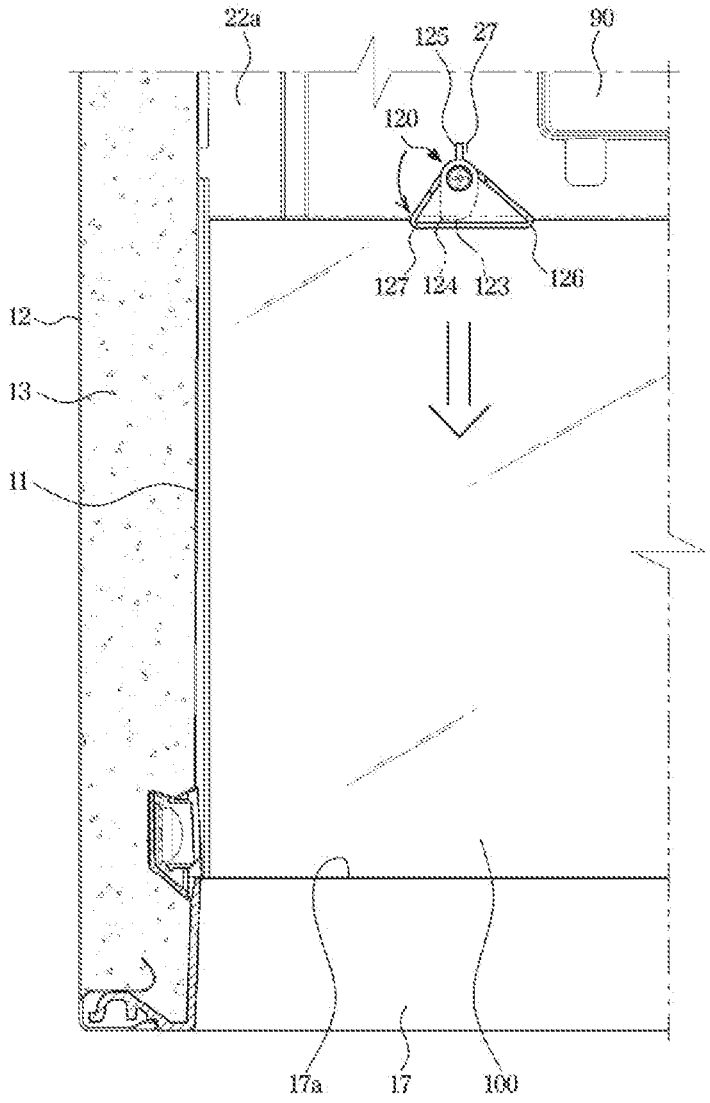
FIG. 8 shows a state in which the fixer shown in FIG. 5 is oriented in a second position.
Figure 9:
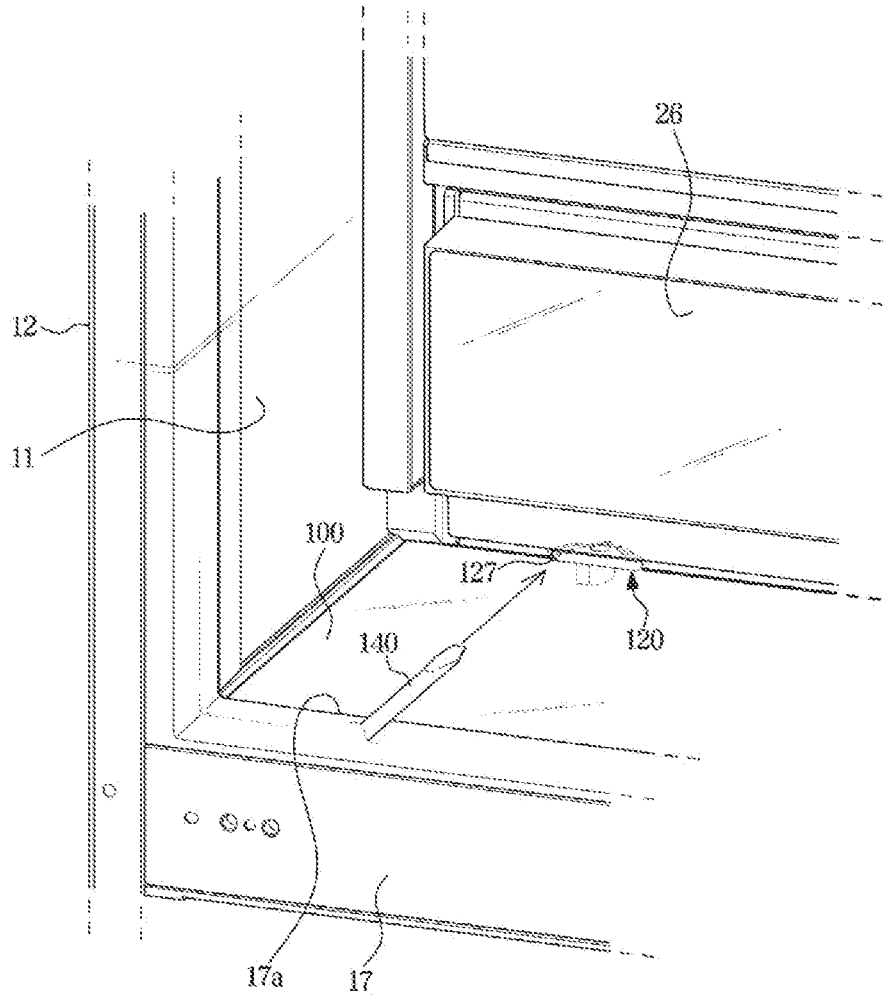
FIG. 9 shows moving the fixer from the state shown in FIG. 8 to the state shown in FIG. 7.

FIG. 5 is an enlarged view of an area B denoted in FIG. 2, showing a state in which a fixer is separated from the main body. FIG. 6 shows a state in which the display shown in FIG. 2 is separated from the main body. FIG. 7 shows a state in which the fixer shown in FIG. 5 is oriented in a first position. FIG. 8 shows a state in which the fixer shown in FIG. 5 is oriented in a second position. FIG. 9 shows moving the fixer from the state shown in FIG. 8 to the state shown in FIG. 7.

Referring to FIGS. 2 to 5, the refrigerator 1 according to an embodiment of the disclosure may include a fixer 120 for selectively fixing the display 100 to the main body 10. The fixer 120 may be rotatably coupled with the main body 10. More specifically, the fixer 120 may be rotatable between a first position of releasing the display 100 from the main body 10 and a second position of fixing the display 100 to the main body 10.

More specifically, the main body 10 may include a fixer supporter 28 for rotatably supporting the fixer 120. The fixer 120 may include a coupling portion 121 into which the fixer supporter 28 is rotatably inserted. By coupling the coupling member 130 in a state in which the fixer 120 is coupled with the fixer supporter 28, the fixer 120 may be prevented from escaping from the main body 10.

Referring to FIG. 6, the fixer 120 may be positioned below the storage container 26 upon installing of the storage container 26 in the main body 10. A plurality of fixers 120 may be provided. The fixer 120 may be hidden by the storage container 26 at the second position of fixing the display 100. After the display 100 is installed in the main body 10, the fixer 120 may not protrude from the storage container 26, which implements a tidy outer appearance of the upper storage room 22.

The display 100 may include a guide body 107 for guiding to a coupling location upon coupling with the bottom 22*a* of the upper storage room 22. On the bottom 22*a* of the upper storage room 22, a guide portion 118 may be formed to correspond to the guide body 107.

The display 100 may be primarily installed on the bottom 22*a* of the upper storage room 22 by moving the guide body 107 in a direction of inserting the guide body 107 into the guide portion 118, that is, in a front direction in a state of locating a rear end of the display 100 close to the fixer 120. The guide portion 118 and the guide body 107 may prevent the display 100 from being damaged upon installing/separating of the display 100 in/from the main body 10.

The fixer 120 may include a pressing portion 123 for pressing the display 100 at the second position of fixing the display 100.

The fixer 120 may include a fixing portion 126 protruding from the storage container 26 to be exposed to outside at the first position of releasing the display 100.

More specifically, referring to FIG. 7, the fixer 120 may be positioned such that the fixing portion 126 is toward the front direction. The pressing portion 123 of the fixer 120 may be positioned at a location that is not toward the display 100. That is, the pressing portion 123 of the fixer 120 may be spaced from the display 100. The pressing portion 123 of the fixer 120 may be toward one side wall of the upper storage room 22. The display 100 may be primarily coupled with the bottom 22*a* of the upper storage room 22 in a direction toward the fixer 120. The position of the fixer 120, shown in FIG. 7 may be the first position.

Referring to FIG. 8, according to pressing of the fixing portion 126 by a user to rotate the fixer 120 to about 90 degrees in a counterclockwise direction, the pressing portion 123 may move to a location of pressing the display 100 in the front direction. However, because the fixer 120 includes a rotation limiting portion 124 adjacent to the pressing portion 123, the fixer 120 may be prevented from rotating to a preset angle or more by the display 100. That is, the rotation limiting portion 124 may be supported by one side end of the display 100 to prevent the fixer 120 from rotating. The position of the fixer 120, shown in FIG. 8 may be the second position.

According to a rotation of the fixer 120 from the first position to the second position, a catching portion 125 of the fixer 120 may cross a stopper 27 formed on the bottom 22*a* of the upper storage room 22. The stopper 27 may protrude from the bottom 22*a* of the upper storage room 22. The stopper 27 may interfere with the catching portion 125.

Accordingly, a certain magnitude of force or more for causing the catching portion 125 to cross the stopper 27 may be needed to move the fixer 120 from the first position to the second position.

Meanwhile, after the catching portion 125 crosses the stopper 27, the catching portion 120 of the fixer 120 may be supported by the stopper 27 in the counterclockwise direction, and the rotation limiting portion 124 may be supported by the one side end of the display 100 in the clockwise direction. Accordingly, the fixer 120 may be prevented from rotating and fixed in position.

That is, at the second position of the fixer 120, the pressing portion 123 may press the display 100 in the front direction by the rotation limiting portion 124 and the catching portion 125, and accordingly, a front end of the display 100 may be in close contact with the main body 10. More specifically, the front end of the display 100 may be in close contact with a display supporter 17*a* of the main body 10. The display 100 may be fixed between the display supporter 17*a* and the fixer 120.

Referring to FIG. 9, to move the fixer 120 from the second position to the first position, the user may press a releasing portion 127 of the fixer 120 with a tool 140. In this case, the user may need to press the releasing portion 127 of the fixer 120 with a certain magnitude of force or more to cause the catching portion 125 to cross the stopper 27.

In a case in which the fixer 120 is oriented in the second position of fixing the display 100, as shown in FIG. 9, the fixer 120 may be positioned below the storage container 26 without protruding in the front direction from the storage container 26, and accordingly, upon opening of the upper storage room 22, a tiny outer appearance may be implemented.

According to the configuration, the refrigerator 1 according to an embodiment of the disclosure may easily couple the display 100 with the main body 10 or easily separate the display 100 from the main body 10, resulting in an improvement of productivity and/or assembly property.

In addition, at the second position of the fixer 120, the fixer 120 may be fixed in position by the rotation limiting portion 124 and the catching portion 125 to stably fix the display 100. That is, to move the fixer 120 from the second position to the first position, a certain magnitude of force for causing the catching portion 125 to cross the stopper 27 may need to be applied to the fixer 120, and accordingly, the fixer 120 may be prevented from easily releasing fixing of the display 100.

Figure 10:
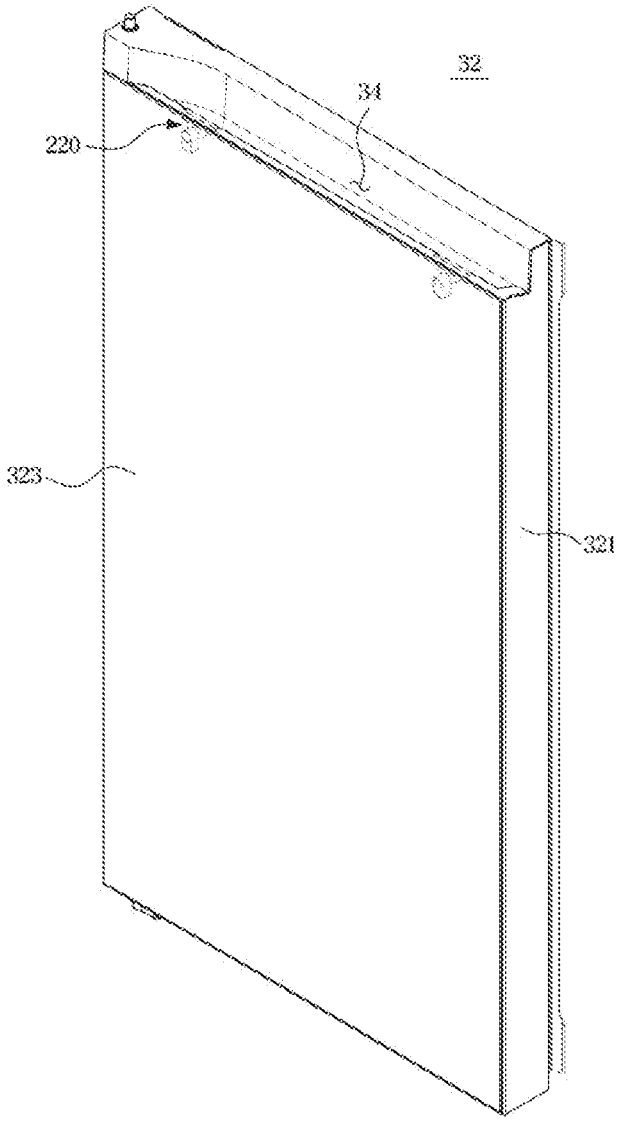
FIG. 10 shows applying a fixer according to another embodiment to a second door shown in FIG. 1.
Figure 11:
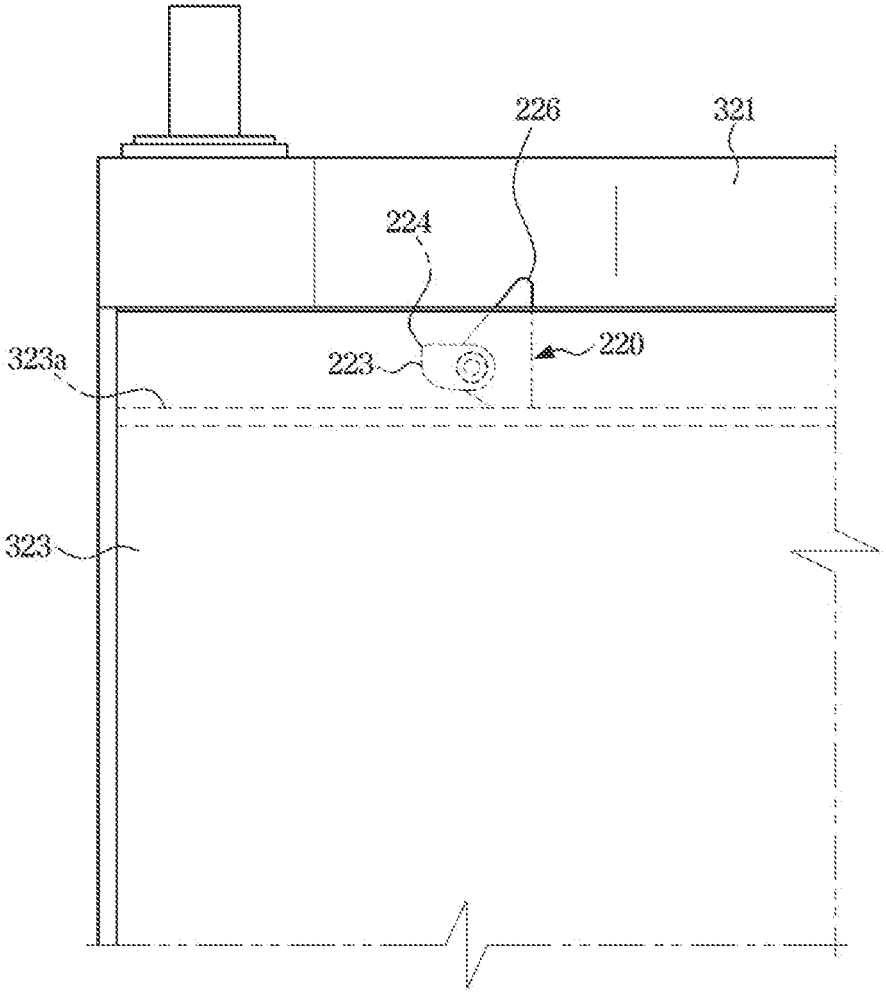
FIG. 11 shows a state in which the fixer shown in FIG. 10 is oriented in a first position.
Figure 12:
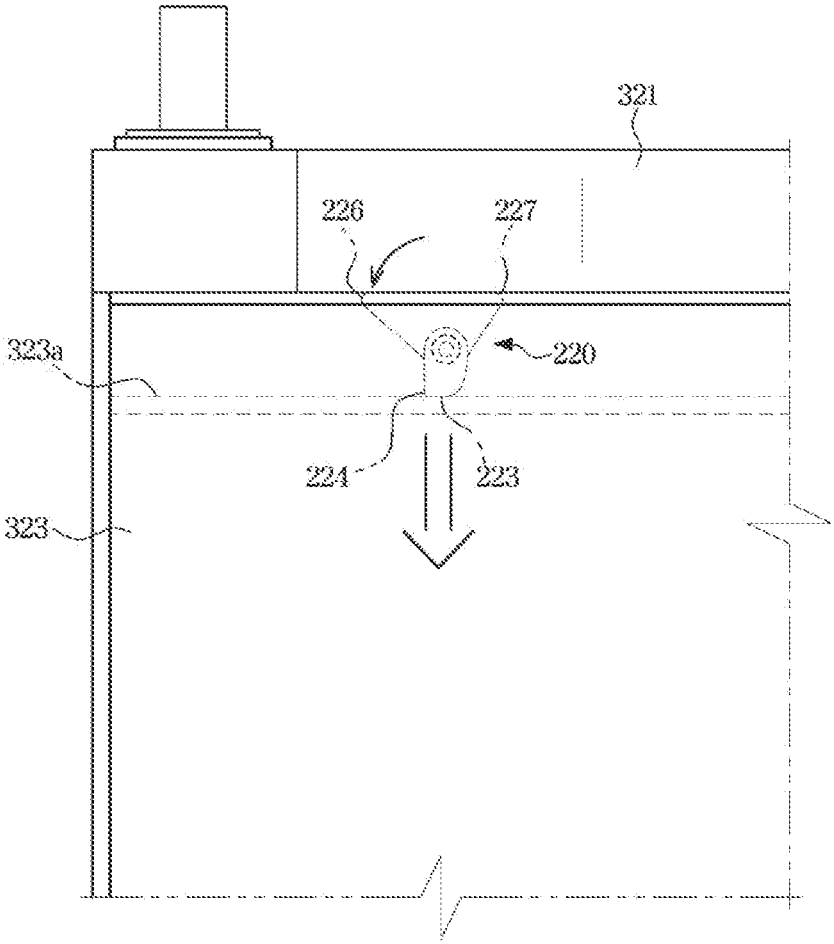
FIG. 12 shows a state in which the fixer shown in FIG. 10 is oriented in a second position.

FIG. 10 shows applying a fixer according to another embodiment to a second door shown in FIG. 1. FIG. 11 shows a state in which the fixer shown in FIG. 10 is oriented in a first position. FIG. 12 shows a state in which the fixer shown in FIG. 10 is oriented in a second position.

A case in which a fixer according to another embodiment of the disclosure is applied to the second door 32 will be described with reference to FIG. 10.

The second door 32 may include a door body 321, and a panel body 323 detachably coupled with the door body 321. The second door handle 34 may be formed in the top surface of the second door 32 as recessed from the top surface of the second door 32. The fixer 220 may be positioned inside the second door handle 34.

Referring to FIG. 11, a fixing supporter 323*a* may be formed on a rear surface of the panel body 323. The fixing supporter 323*a* may protrude backward from a rear surface of the panel body 323. The fixer 220 may be oriented in a first position of not pressing the panel body 323. The panel body 323 may be primarily coupled with the door body 321 by supporting a lower end of the panel body 323 on the door body 321 and then moving an upper end of the panel body 323 toward the fixer 220.

Referring to FIG. 12, a user may rotate the fixer 220 with respect to the door body 321 by pressing the fixing portion 226. Accordingly, a pressing portion 223 may press a fixing supporter 323*a*, and the lower end of the panel body 323 may be in close contact with the door body 321.

The fixer 220 may be prevented from rotating in an opposite direction of a direction of rotating from the second position to the first position by a rotation limiting portion 224.

The user who intends to separate the panel body 323 from the door body 321 may press the releasing portion 127 to rotate the fixer 120 to the state shown in FIG. 7. Accordingly, the pressing portion 223 may be spaced from the fixing supporter 323*a*, and the panel body 323 may be separable from the door body 321.

According to the configuration, the fixer 220 according to another embodiment of the disclosure may easily separate the panel body 323 of the second door 32 from the door body 321.

In addition, the fixers 120 and 220 according to the embodiments of the disclosure are not limited to a refrigerator, and may be applied to selectively fix a part that is detachably coupled with main bodies of various household appliances, such as a washing machine, an air conditioner, an air purifier, and/or a cleaner. The part may be a device such as the display 100 shown in FIGS. 1 to 9, or may be a member such as the panel body 323 shown in FIGS. 10 to 12.

So far, specific embodiments have been shown and described. However, the disclosure is not limited to the above-described embodiments, and various modifications can be made by those skilled in the technical art to which the disclosure belongs without departing from the gist of the technical idea of the disclosure defined by the claims below.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a main body forming a storage room;

a display positioned on a bottom of the storage room and including a display board; and a separating wall extending from the bottom of the storage room toward the display and forming a board accommodating space for accommodating the display board, the separating wall configured to partition the board accommodating space from a water collecting space between the bottom of the storage room and the display, wherein the display board and the water collecting space are disposed horizontally.

2. The refrigerator of claim 1, further comprising a seal positioned between the separating wall and the display and configured to seal the board accommodating space from the water collecting space.

3. The refrigerator of claim 1, wherein the separating wall is formed in a shape of a closed loop to form the board accommodating space.

4. The refrigerator of claim 1, wherein a bottom of the board accommodating space is lower than a bottom of the water collecting space.

5. The refrigerator of claim 1, wherein the board accommodating space comprises a wire connecting space configured to guide a wire of the display to an outside of the storage room.

6. The refrigerator of claim 1, wherein the display board is spaced from the bottom of the storage room within the board accommodating space.

7. The refrigerator of claim 1, further comprising a drain hole formed in the bottom of the storage room, wherein the main body is configured to guide water of the water collecting space to the drain hole.

8. The refrigerator of claim 1, further comprising a guide portion formed on the bottom of the storage room, wherein the display comprises a guide body that is guided by the guide portion for installation on the main body.

9. The refrigerator of claim 1, further comprising a fixer configured to selectively fix the display to the main body.

10. The refrigerator of claim 9, wherein the fixer is rotatable between a first position of releasing the display from the main body and a second position of fixing the display to the main body.

11. The refrigerator of claim 10, wherein the fixer comprises a pressing portion configured to press the display at the second position.

12. The refrigerator of claim 10, further comprising a storage container provided in the storage room, wherein the fixer is hidden by the storage container at the second position.

13. The refrigerator of claim 12, wherein the fixer comprises a fixing portion protruding from the storage container to be exposed to an outside of the storage container at the first position.

14. The refrigerator of claim 10, further comprising a stopper protruding from the bottom of the storage room, wherein the fixer comprises a rotation limiting portion supported in a first direction by the display and a catching portion supported in a second direction that is opposite to the first direction by the stopper, at the second position.

15. The refrigerator of claim 1, further comprising:

a storage container provided in the storage room; and a heater configured to provide heat to the storage container, the heater positioned adjacent to the water collecting space.

16. A refrigerator comprising:

a main body forming a storage room;

a display positioned on a bottom of the storage room and including a display board; and a separating wall extending from the bottom of the storage room toward the display and forming a board accommodating space for accommodating the display board, the separating wall configured to partition the board accommodating space from a water collecting space between the bottom of the storage room and the display; and a fixer configured to rotate between a first position of releasing the display from the main body and a second position of fixing the display to the main body, the fixer including a fixing portion protruding into the storage room at the first position.

17. The refrigerator of claim 16, further comprising a seal positioned between the separating wall and the display and configured to seal the board accommodating space from the water collecting space.

18. The refrigerator of claim 16, wherein the separating wall is formed in a shape of a closed loop to form the board accommodating space.

19. The refrigerator of claim 16, wherein a bottom of the board accommodating space is lower than a bottom of the water collecting space.

20. The refrigerator of claim 16, wherein the board accommodating space comprises a wire connecting space configured to guide a wire of the display to an outside of the storage room.

* * * * *